US007380703B2

(12) United States Patent
Ogden

(10) Patent No.: US 7,380,703 B2
(45) Date of Patent: Jun. 3, 2008

(54) CARTON FOR STORING AND CARRYING OBJECTS

(75) Inventor: Stephen F. Ogden, Surrey (CA)

(73) Assignee: Tree Island Industries Ltd., British Columbia (CA)

( * ) Notice: Subject to any disclaimer, the term of this patent is extended or adjusted under 35 U.S.C. 154(b) by 0 days.

(21) Appl. No.: 11/372,654

(22) Filed: Mar. 10, 2006

(65) Prior Publication Data

US 2007/0210143 A1 Sep. 13, 2007

(51) Int. Cl.
*B65D 5/46* (2006.01)
*B65D 43/22* (2006.01)
*B65D 5/08* (2006.01)

(52) U.S. Cl. ..... 229/117.13; 229/117.16; 229/117.23; 229/125.39; 229/138

(58) Field of Classification Search ..... 229/117.12, 229/117.13, 117.14, 117.15, 117.16, 117.23, 229/138, 125.37, 125.38, 125.39
See application file for complete search history.

(56) References Cited

U.S. PATENT DOCUMENTS

| | | | | | |
|---|---|---|---|---|---|
| 377,977 | A | * | 2/1888 | Baker | 229/138 |
| 903,455 | A | * | 11/1908 | Davis | 229/138 |
| 1,984,611 | A | | 12/1934 | Weaver | |
| 2,037,770 | A | * | 4/1936 | Driver | 229/117.18 |
| 2,596,087 | A | | 5/1952 | Shoudy | |
| 2,810,506 | A | | 10/1957 | Kessler | |
| 2,828,905 | A | | 4/1958 | Frizzell | |
| 3,275,215 | A | | 9/1966 | Paige | |
| 3,762,627 | A | * | 10/1973 | Ross et al. | 229/117.13 |
| 3,927,824 | A | * | 12/1975 | Razziano | 229/117.14 |
| 3,938,731 | A | | 2/1976 | Ross, Jr. et al. | |
| 4,341,341 | A | | 7/1982 | Roccaforte | |
| 4,415,117 | A | | 11/1983 | Pollard | |
| 4,783,788 | A | | 11/1988 | Gordon | |
| 4,981,254 | A | | 1/1991 | Depper | |
| 5,020,337 | A | | 6/1991 | Krieg | |
| 5,060,850 | A | | 10/1991 | Weaver | |
| 5,143,243 | A | * | 9/1992 | Colling | 229/117.13 |
| 5,779,049 | A | | 7/1998 | Werby et al. | |
| 5,853,121 | A | * | 12/1998 | Francisco | 229/117.14 |
| 6,581,823 | B1 | * | 6/2003 | De Beck | 229/117.14 |
| 2004/0200890 | A1 | | 10/2004 | Mesly | |
| 2006/0081690 | A1 | * | 4/2006 | Bates et al. | 229/117.16 |
| 2006/0091190 | A1 | * | 5/2006 | Nikolai | 229/117.14 |

* cited by examiner

*Primary Examiner*—Gary E Elkins
(74) *Attorney, Agent, or Firm*—Holland & Knight LLP; Richard E. Lyon, Jr.

(57) ABSTRACT

A storage and carrying carton formed of a foldable sheet of material and adapted to be secured in a closed disposition with a flexible closure strap. The sheet of material is configured such that when folded into the carton configuration, it defines an upper flap that cooperates with the closure strap to define a carrying handle. Upon severing the strap to open the carton, the upper end of the carton is configured so as to be selectively folded flat and resealed with a second closure strap or, alternatively, folded so as to define upstanding lateral handles by which the opened carton and its contents can be readily carried.

8 Claims, 5 Drawing Sheets

CARTON FOR STORING AND CARRYING OBJECTS

BACKGROUND OF THE INVENTION

The present invention relates to an improved storage and carrying carton particularly adapted for use in storing and carrying loads of approximately 50-60 pounds. Nails and other metal fasteners and hardware are examples of products typically stored and carried in the cartons of the type to which the present invention relates. These cartons are typically of a "bellows" style and formed of a corrugated cardboard material. Sheets of the cardboard material are cut and scored such that the carton can be readily formed by folding, gluing, stapling or taping. The bottom flaps are typically folded together and secured by the use of glue, staples or tape prior to filling. The top flaps are normally secured by folding the flaps together into a flat disposition over the upper end of the filled carton and a strap formed of a plastic or other suitable material is wrapped about the entire carton and sealed in place. So secured, the strap forms a natural handle, albeit somewhat awkward to use, for lifting the package. Such a design, however, relies on the strap being in place to both secure the carton and provide a lifting handle. Removal of the strap, which is normally achieved by cutting, not only makes the carton difficult to re-close but effectively eliminates the lifting handle. It would be highly desirable to provide a carton that could be as easily formed as the bellows-style cartons currently in use but which provided both a more convenient lifting handle when the carton is sealed and a means for readily re-closing and carrying the carton after the removal of the strap. The carton of the present invention obtains these results.

SUMMARY OF THE INVENTION

Briefly, the present invention comprises a storage and carrying container of the bellows type in which the upper end flaps are provided with triangularly-shaped scoring, elongated apertures centrally disposed within the scoring adjacent the lower ends of the end flaps and cut-out lateral portions in the upper end portions of the end flap adjacent the side flaps. Pressing the scored end flaps inwardly before the side flaps, will cause the end flaps to fold outwardly along the scoring forming two triangularly-shaped projections extending inwardly and flush along the top of the carton and drawing the side flaps inwardly. Thus, upon pressing the side flaps over the end flaps and flush with the top of the carton and securing a conventional flexible closure strap about the carton and the overlapping upper side flaps, a filled carton can be readily sealed. By configuring the side flaps such that they each define a length that is greater than one-half the transverse width of the carton, the extended end portion of the uppermost side flaps will project laterally from the centrally secured closure strap such that one can slide his or her fingers under the projecting end portion and thus use the end portion that is anchored by the strap as a convenient handle for carrying the container in a filled and sealed disposition.

After the carton has been opened by severing the strap, pressing the side flaps inwardly over the open end of the box into a flush disposition will cause the end flaps to fold inwardly along the inclined score lines therein so as to again define the two triangularly-shaped projections. Openings are provided in the base of the formed projections to receive one's fingers. By folding the formed projections to an upright position, lateral handles are conveniently formed and positioned for carrying the opened carton. By folding the end flaps along the score lines, the formed triangularly-shaped projections are of a double thickness so as to form durable handles for carrying a filled carton without a securement strap. By forming the hand openings in the folded end flaps by means of elongated, generally u-shaped slits, depending flaps are formed that, when pushed inwardly by one's fingers, fold about the upper ends of the hand openings, further strengthening the formed handles and providing a smooth and comfortable gripping surface.

It is therefore the principle object of the present invention to provide an improved carton for the storage and carrying of objects in which the carton defines gripping handles for carrying the carton in both the opened and sealed disposition.

DETAILED DESCRIPTION OF THE PREFERRED EMBODIMENTS

Figure 1:
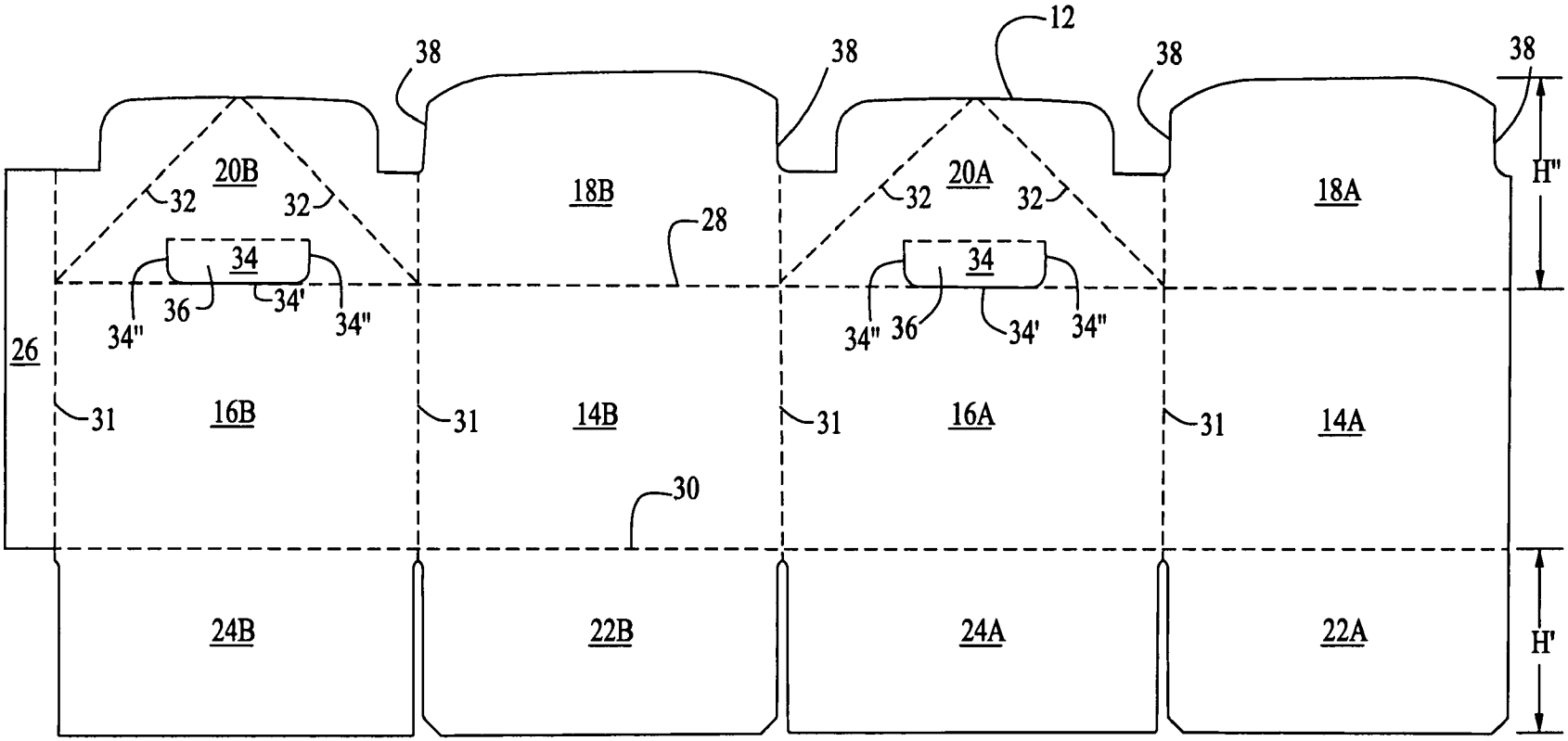
FIG. 1 is a top plan view of a single sheet of material for forming the carton of the present invention.

Referring now in detail to the drawings, the carton 10 of the present invention is preferably formed from a sheet 12 of a suitable flexible material such as corrugated cardboard. As seen in FIG. 1, sheet 12 defines a pair of side panels 14*a* and 14*b*, end panels 16*a* and 16*b*, upper side flaps 18*a* and 18*b*, upper end flaps 20*a* and 20*b*, lower side flaps 22*a* and 22*b*, lower end flaps 24*a* and 24*b* and a securement tab 26 projecting laterally from end panel 16*b* and the adjacent upper end flap 20*b*. Horizontal fold lines 28, preferably formed by scoring the cardboard material, are provided at the interface of the side and end panels and the upper side and end flaps. Horizontal fold lines 30, also preferably formed by scoring, are provided at the interface of the side and end panels and the lower side and end flaps. Vertical fold lines 31 are provided between each adjacent panels and flaps as shown in FIG. 1. Inclined fold lines 32, formed by scoring, are provided in the upper end flaps 20*a* and 20*b* and are positioned so as to cooperate with fold lines 28 such that the fold lines in each of the upper end flaps define a triangular configuration with the apex 33 of each formed triangle being centrally disposed in the upper ends of the upper end flaps 20*a* and 20*b* as seen in FIG. 1.

An elongated, generally rectangular, partial cutout area 34 is centrally provided in each of the two upper end flaps 20*a* and 20*b* adjacent fold line 28. Areas 34 are preferably each defined by an elongated and generally unshaped slit 34' extending horizontally through sheet 12 along fold 28 and terminating in opposed parallel vertical portions 34". For reasons that will become apparent, such a configuration allows one to merely press their fingers against the formed flaps 36 defined by slits 34', bending flaps 36 inwardly and through the formed openings 34. So as not to obstruct openings 34 upon the formation of carton 10 from sheet 12, substantially rectangular slots 38 are formed in the upper ends of the upper end flaps 20*a* and 20*b* adjacent the upper side flaps 18*a* and 18*b* as shown in FIG. 1.

Figure 2:
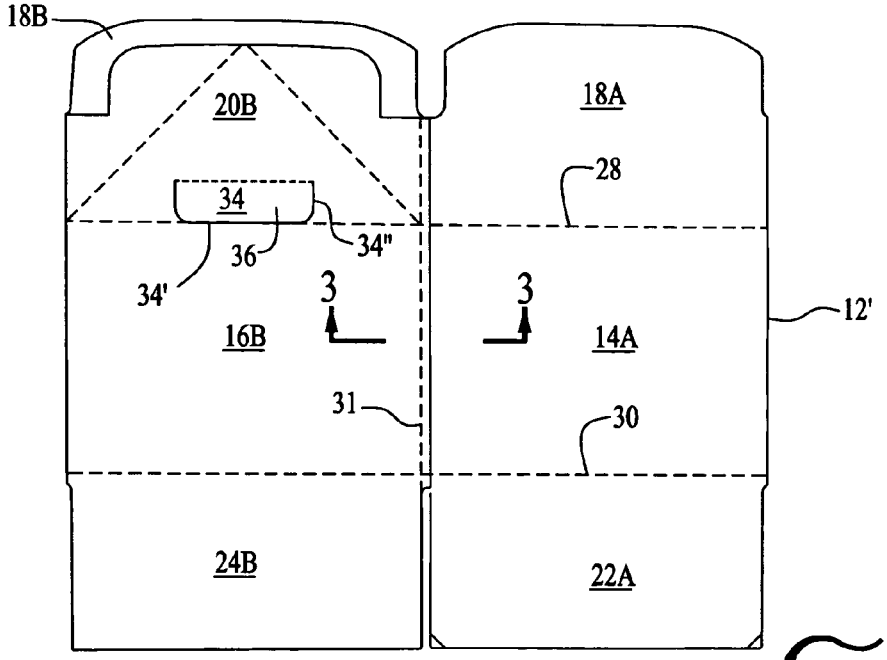
FIG. 2 is a top plan view of the sheet of material illustrated in FIG. 1 with the extended ends secured together and the material folded and pressed flat into a storage configuration.

To form the carton 10 of the present invention from flat sheet 12, the sheet is folded along vertical fold lines 31 and the securement tab 26 is suitably adhered to the lateral end portion of side panel 14*a* and the adjacent upper side flap 18*a* such that the folded sheet 12 now defines a flat folded and endless sheet 12', as illustrated in FIG. 2. Such a configuration is convenient for storage and shipping prior to the sheet being subsequently folded and secured to define the carton 10.

Figure 4:
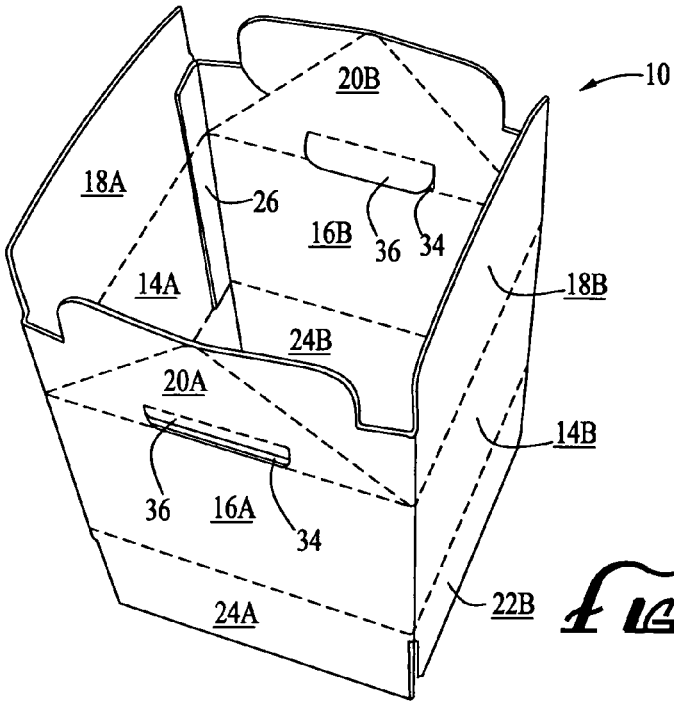
FIG. 4 is a perspective view of the sheet of material unfolded into a box configuration.
Figure 3:
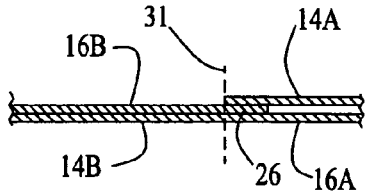
FIG. 3 is a sectional view taken along the line 3-3 of FIG. 2.

To form the flat folded endless sheet 12' into carton 10, one need only lift the end panel 16*b* and side panel 14*a* and their integrally formed upper and lower flaps relative to panels 16*a* and 14*b* so as to bring the carton from its collapsed flat disposition illustrated in FIG. 2 to the open box configuration illustrated in FIG. 4. The lower end and side flaps are then folded inwardly and sealed in a conventional manner (e.g. by an adhesive or stapling) to define a closed and sealed bottom end 40 for the carton 10 as seen in FIG. 5.

In the embodiment of the invention illustrated in the drawings, the carton 10 is of a square configuration. The vertical heights H' of the lower side and end flaps are equal to each other and to one-half of the transverse dimension of the formed carton. Accordingly, when the flaps are folded as described, two of the opposed flaps will form the inner surface of the bottom of the container with the extended ends of those flaps being in abutment and the outer surface of the other two opposed flaps will form the outer bottom surface of the container with the extended ends of those flaps being in abutment. A suitable adhesive or staples preferably are employed to secure the flaps comprising the inner surface of the carton bottom to the flaps forming the bottom outer surfaces to provide the carton with a secure bottom wall of double thickness. If a rectangular carton were employed, the height of the end flaps preferably would be greater than the height of the side flaps such that the ends of each pair of flaps would be in abutment to provide the double wall thickness of the bottom of the container.

Figure 5:
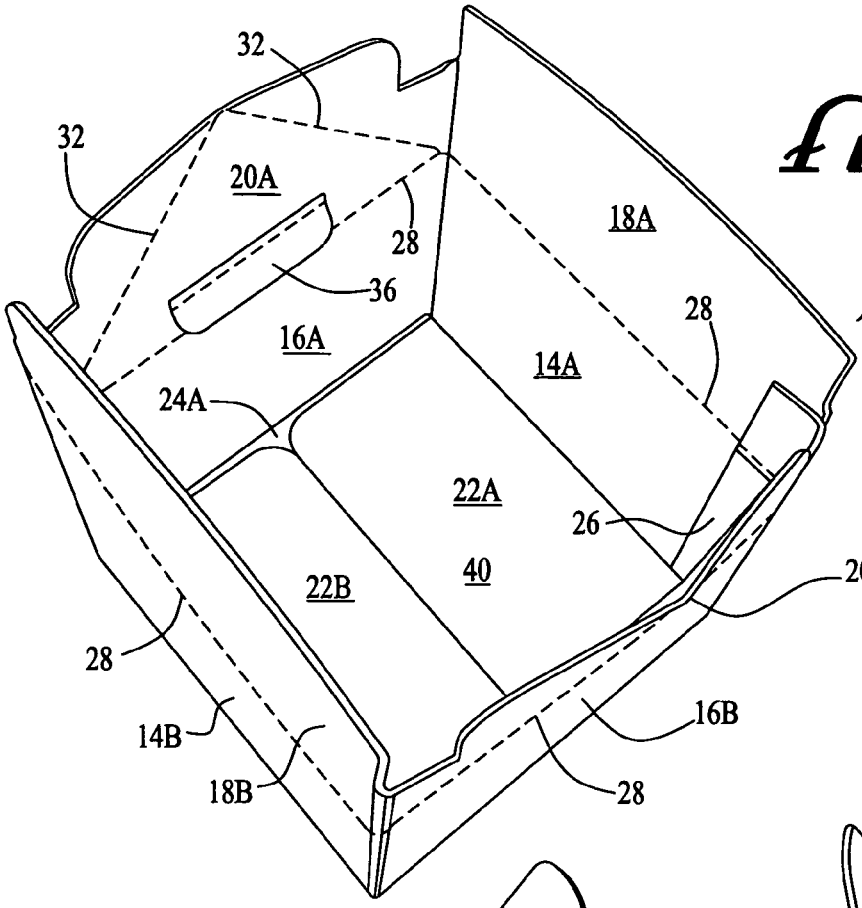
FIG. 5 is a perspective view of the sheet of material unfolded into a box configuration with the lower flaps folded and secured in place to form an open carton.
Figure 6:
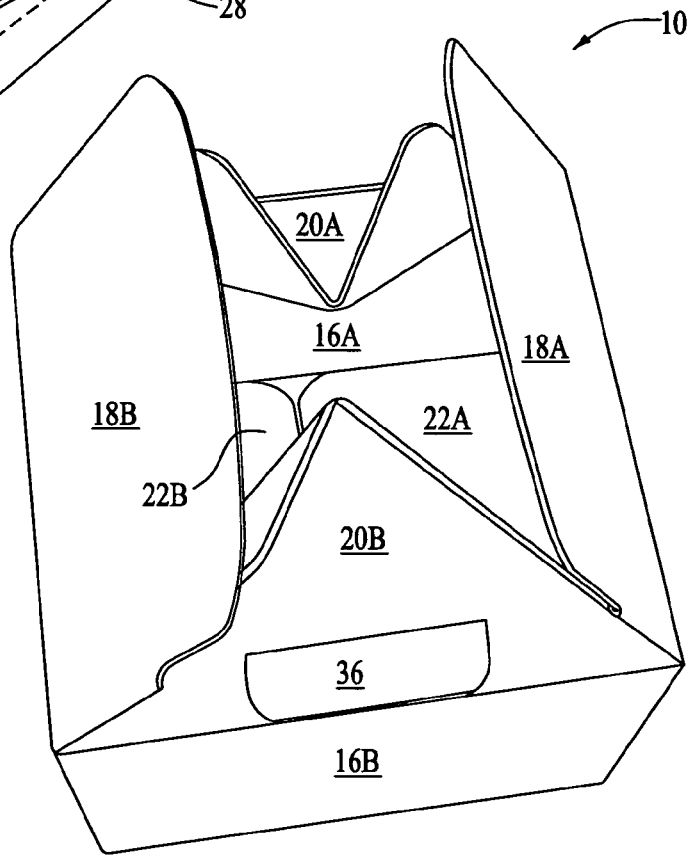
FIG. 6 is a perspective view of the carton of the present invention with the upper flaps being folded into a closed configuration.
Figure 7:
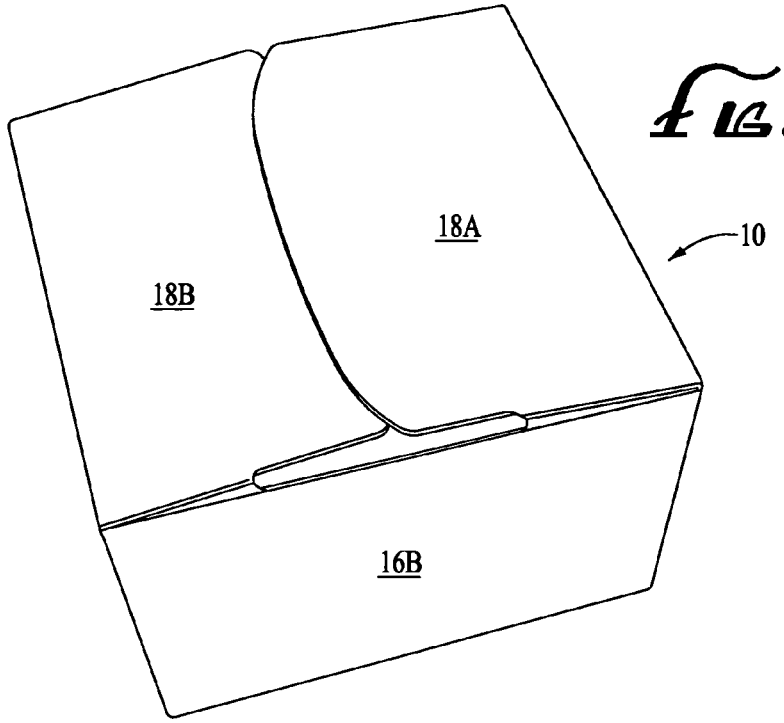
FIG. 7 is a perspective view of the carton of the present invention with the upper flaps being folded flat into a closed position.
Figure 8:
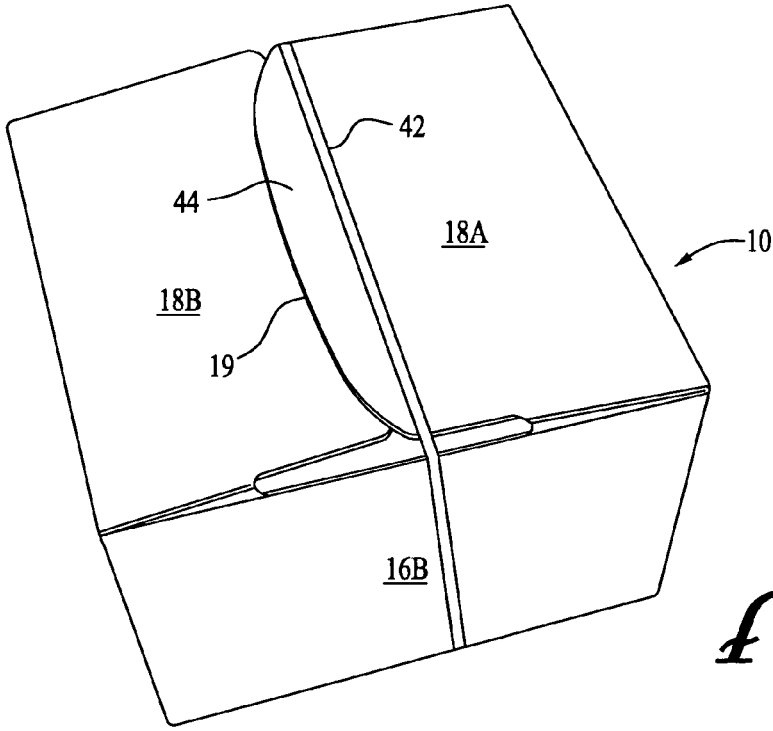
FIG. 8 is a perspective view of the carton of the present invention in a closed and sealed configuration.

As seen in FIG. 5, the carton 10 is now in position to be filled with product. The upper horizontal fold line 28 also defines a fill line for the contents of the container 10. Upon being filled, the carton is sealed by folding the upper end panels inwardly along fold line 28, causing the upper end panels 20*a* and 20*b* to fold outwardly along the scored inclined fold lines 32 formed therein and inwardly along line 28, drawing the upper side flaps inwardly as seen in FIG. 6. Upon pressing the upper end flaps into a flush disposition with the upper end of the container and pressing the upper side flaps 18*a* and 18*b* downwardly thereover, the carton is closed as illustrated in FIG. 7 whereupon a flexible closure strap 42 can be centrally disposed about the carton, and fixed in place, sealing the filled carton as seen in FIG. 8.

The closure strap 42 is positioned such that it runs parallel to the outer end 19 of the exposed upper side flap 18*a*. The heights H" of the two upper side flaps 18*a* and 18*b* are preferably equal to each other and exceed the transverse dimension of the formed carton so that when the upper end and side flaps are folded flush over the end flaps and secured with strap 42, the exposed end 19 of the uppermost upper side flap will extend parallel to and be spaced laterally from the securement strap 42 a distance of about 1.5 to 2.5 inches, and more preferably 1.0 to 2.0 inches, so as to ensure securement of the flap by the strap while allowing the portion 44 of the exposed flap between strap 42 and end 19, which is anchored by the strap, to function as a convenient carrying handle for the container in a filled and sealed disposition. One can simply insert his or her fingers under the anchored end 19 of the exposed side flap to lift the carton and its sealed contents.

Figure 9:
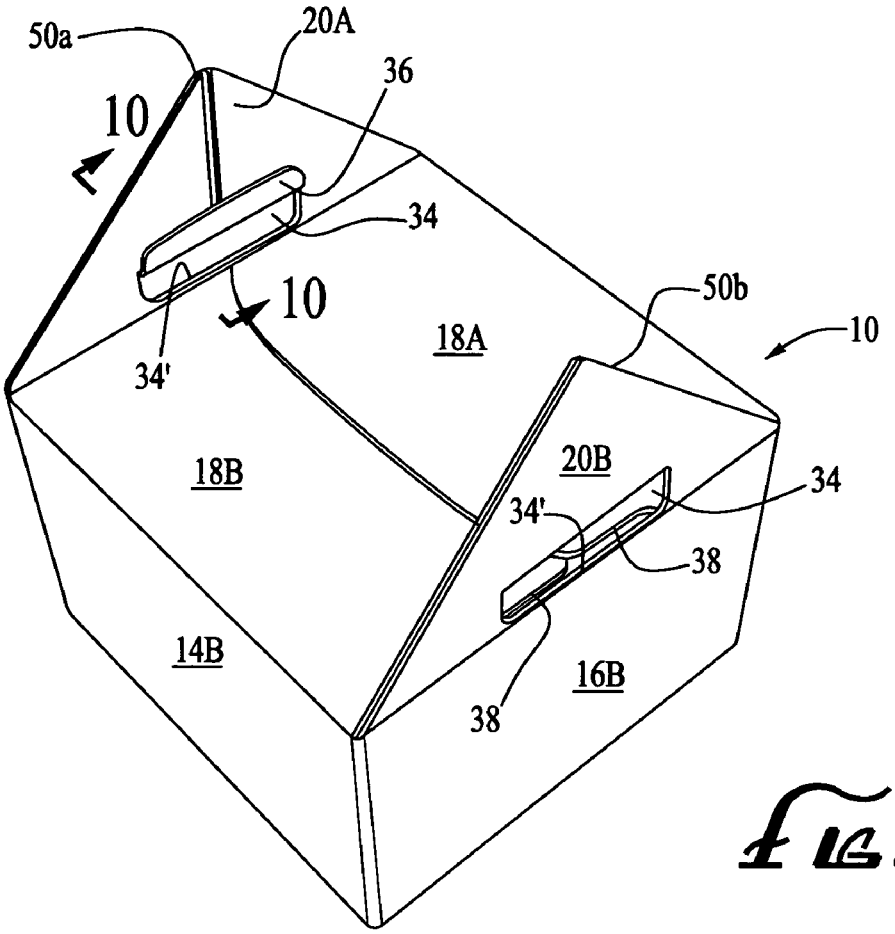
FIG. 9 is a perspective view of the carton of the present invention in a carrying mode upon removal of the securement strap.
Figure 10:
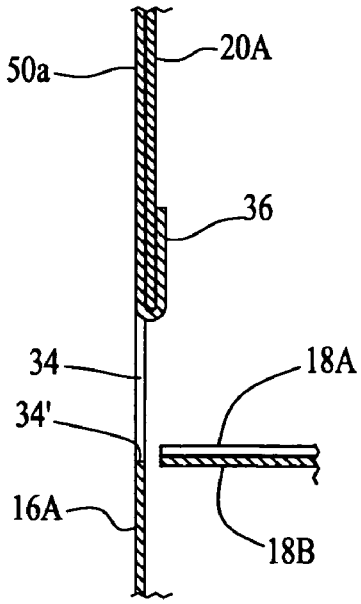
FIG. 10 is a section view taken along the line 10-10 in FIG. 9.

Once the strap 42 has been severed to open the carton, the carton 10 defines its own carrying handles. The upper side flaps 18*a* and 18*b* are folded inwardly and flush with the upper end of the carton 10. Upon so doing, the upper end flaps will again fold upon themselves along the fold lines 32, but outwardly along line-28 and inwardly along the inclined lines 32, forming two outwardly extending, opposed triangularly-shaped projections 50*a* and 50*b* as seen in FIG. 9. Upon folding projections 50*a* and 50*b* into vertical orientations and pressing one's fingers through the open areas 34 defined by slits 34', the projections 50*a* and 50*b* define sturdy handles for carrying the previously opened carton and its contents. In this carrying mode, the projections 50*a* and 50*b* formed by the folded upper end flaps are of double thickness so as to render the handles quite sturdy for carrying a relatively heavy load. The lateral slots 38 were formed in the upper side flaps 18*a* and 18*b* for alignment with the openings 34 in the upper end flaps 20*a* and 20*b* to accommodate the two ply handles 50*a* and 50*b* without obscuring the hand openings 34. By forming the hand openings 34 with the elongated, generally U-shaped slits 34' as above described, the depending flaps 36 that are formed in the end panels which, when pushed inwardly by one's fingers to access hand openings 34, fold about the upper ends 34' of the hand openings as seen in FIG. 10. So positioned, the flaps 36 reinforce and strengthen the formed handles 50*a* and 50*b* and provide a smooth comfortable gripping surface about the upper ends 34' of the hand openings 34.

Various changes and modifications may be made in carrying out the present invention without departing from the spirit and scope thereof. Insofar as these changes and modifications are within the purview of the appended claims, they are to be considered as part of the present invention.

What is claimed is:

1. A storage and carrying carton foldable between an opened carrying disposition and closed storage disposition, said carton comprising a sheet of foldable material and a flexible closure strap, said sheet including a plurality of fold lines therein and being foldable along said lines to define a pair of opposed side panels, a pair of opposed end panels, a bottom and a closable upper opening formed by a pair of upper side flaps and a pair of upper end flaps, said upper side and end flaps being selectively foldable such that said upper side flaps extend inwardly across said opening and said upper end flaps define a pair of opposed outwardly extending and triangularly configured projections, said projections defining upstanding carrying handles for said carton in said opened carrying position upon being folded to an upright disposition, alternatively, said upper side and end flaps being foldable into a flat overlapping disposition extending across said closable upper opening, each of said side flaps being sized to extend inwardly across said closable upper opening a distance greater than one-half of the transverse distance across said opening such that upon securing said closure strap about said flatly disposed and overlapping flaps and about a central portion of the carton, a portion of one of said side flaps extends from the closure strap and cooperates with said strap to define a carrying handle for the carton in said closed disposition.

2. The carton of claim 1 wherein upper side flaps are sized to extend inwardly across said closable upper opening a distance of about 1.5 to 2.5 inches greater than one-half the transverse distance across said opening.

3. The carton of claim 1 wherein upper side flaps are sized to extend inwardly across said closable upper opening a distance of about 1.0 to 2.0 inches greater than one-half the transverse distance across said opening.

4. The carton of claim 1 wherein each of said upper end flaps defines a pair of notches in upper lateral end portions thereof adjacent said upper side flaps and has a slit formed therein comprising an extended horizontal portion terminating in upstanding end portions so as to define a foldable depending flap, said notches being aligned with said flap upon said end flaps being folded so as to define said upstanding carrying handles whereby upon urging said depending flaps inwardly and upwardly, hand openings are formed in said triangularly configured projections with said flaps extending about the upper perimeters of said opening to facilitate the carrying of said carton in said opened disposition by said upstanding handles.

5. A storage and carrying carton comprising a sheet of foldable material and a flexible closure strap, said carton being foldable between an opened carrying disposition and a closed storage disposition and defining a pair of first carrying handles in said opened carrying position and a second carrying handle in said closed disposition, said sheet including a plurality of fold lines therein and being foldable along said lines to define a pair of opposed side panels, a pair of opposed end panels, a bottom and a closable upper opening formed by a pair of upper side flaps and a pair of upper end flaps, said upper side and end flaps being selectively foldable to extend across said opening and define a pair of opposed outwardly extending and triangularly configured projections, said projections defining said pair of first carrying handles upon being folded to an upright disposition, alternatively, said upper side and end flaps being foldable into a flat overlapping disposition extending across said closable upper opening, each of said side flaps being sized to extend inwardly across said closable upper opening a distance greater than one-half of the transverse distance across said opening such that upon securing said closure strap about said flatly disposed and overlapping flaps and about a central portion of the carton, a portion of one of said side flaps extends from the closure strap and cooperates with said strap to define said second carrying handle.

6. The carton of claim 5 wherein upper side flaps are sized to extend inwardly across said closable upper opening a distance of about 1.5 to 2.5 inches greater than one-half the transverse distance across said opening.

7. The carton of claim 5 wherein upper side flaps are sized to extend inwardly across said closable upper opening a distance of about 1.0 to 2.0 inches greater than one-half the transverse distance across said opening.

8. The carton of claim 5 wherein each of said upper end flaps defines a pair of notches in upper lateral end portions thereof adjacent said upper side flaps and has a slit formed therein comprising an extended horizontal portion terminating in upstanding end portions so as to define a foldable depending flap, said notches being aligned with said flap upon said end flaps being folded so as to define said pair of first carrying handles whereby upon urging said depending flaps inwardly and upwardly, hand openings are formed in said triangularly configured projections with said flaps extending about the upper perimeters of said opening to facilitate the carrying of said carton in said opened disposition by said pair of first carrying handles.

* * * * *